US011304873B2

(12) United States Patent
Tulett et al.

(10) Patent No.: US 11,304,873 B2
(45) Date of Patent: Apr. 19, 2022

(54) SPA STRUCTURAL PADDLE ASSEMBLY SYSTEM

(71) Applicant: BULLFROG INTERNATIONAL, LC, Herriman, UT (US)

(72) Inventors: Nathan Tulett, Pleasant Grove, UT (US); Eric Hales, Eagle Mountain, UT (US); Creed Larsen, Murray, UT (US); Robert Santos, Daybreak, UT (US)

(73) Assignee: Bullfrog International, LC, Herriman, UT (US)

( * ) Notice: Subject to any disclaimer, the term of this patent is extended or adjusted under 35 U.S.C. 154(b) by 0 days.

(21) Appl. No.: 17/062,563

(22) Filed: Oct. 3, 2020

(65) Prior Publication Data

US 2021/0100720 A1 Apr. 8, 2021

Related U.S. Application Data

(60) Provisional application No. 62/909,940, filed on Oct. 3, 2019.

(51) Int. Cl.
*A61H 33/00* (2006.01)

(52) U.S. Cl.
CPC ..... *A61H 33/6005* (2013.01)

(58) Field of Classification Search
CPC ..... A61H 33/6005
USPC ... 4/538, 488, 619, 668, 670, 671, 675, 679, 4/695, 696; 52/34
See application file for complete search history.

(56) References Cited

U.S. PATENT DOCUMENTS 2,887,864 A * 5/1959 Tegerdine ..... D06F 29/02 68/26
2002/0053630 A1* 5/2002 Li ..... A45B 17/00 248/519

* cited by examiner

*Primary Examiner* — Lori L Baker
(74) *Attorney, Agent, or Firm* — Dentons Durham Jones Pinegar; Sarah W. Mathews

(57) ABSTRACT

A system for supporting a spa shell may include a structural support paddle. The paddle may include a base portion and a paddle portion, connected to each other through an articulating joint such as a ball-and-socket. The top side of the paddle portion may include one or more pieces of cushioning material, such as EPF foam. The structural paddle assembly may be placed between the base of the spa and the spa shell. Typically 5 or more paddle assemblies are place in a spa for support, such as in the lowest areas of the spa shell and/or concavities, or convexities, of the spa shell. Compared to typical large blocks of foam used to support a spa shell from beneath, the structural support paddles provided increased room below the spa shell for ease of maintenance and installation, and more directly controlled support.

19 Claims, 6 Drawing Sheets

SPA STRUCTURAL PADDLE ASSEMBLY SYSTEM

PRIORITY CLAIM

The present invention claims priority under 35 U.S.C. 119(e) for the benefit of prior-filed provisional application No. 62/909,940, filed 3 Oct. 2019, which is incorporated herein by reference in its entirety.

TECHNICAL FIELD

The present disclosure relates generally to spas and their structural support. More specifically, the present disclosure relates to a system and method of constructing a structural paddle assembly to support a spa structure.

BACKGROUND

Spas are well-known for leisure. Large spas comprise a spa shell that is held within a base by a frame, with a cabinet built around the frame to cover the interior structures that are often unsightly. The spa shell, once filled with water, often weighs at least 3,000 to 6,000 pounds. Because of this large weight, the spa shell is often supported from the bottom within the cabinet. Typically, bulky supports such as large pieces of foam are used. Foam may also be sprayed into the spa cabinet to provide support for the spa shell. However, this may leave very little space within the spa cabinet for other structures such as associated tubing, wiring, etc. Additionally, because large pieces of foam and/or foam spray block tubing within the spa cabinet, it may also make it difficult to service the spa and/or identify and repair any leaks that may occur.

Some or all of the problems, difficulties and drawbacks identified above and other problems, difficulties, and drawbacks may be helped or solved by the spa structural assembly system shown and described herein. The system may also be used to address other problems, difficulties, and drawbacks not set out above or which are only understood or appreciated at a later time. The future may also bring to light currently unknown or unrecognized benefits which may be appreciated, or more fully appreciated, in the future associated with the novel invention shown and described herein.

SUMMARY

A structural support system for a spa is described herein, and in some configurations, the system may comprise: a base, the base comprising a lower portion and an upper portion, the lower portion comprising a post and the upper portion comprising a ball joint; a paddle, the paddle comprising a top side and a bottom side, the bottom side of the paddle comprising a socket to mate with the ball joint of the base, and the top side having one or more pieces of cushioning material attached thereto.

According to one aspect, the ball joint may comprise a partial cylinder having one or more grooves formed therein. In some configurations, the bottom side of the paddle comprises one or more ribs attached thereto.

According to another aspect, the top side of the paddle comprises a tray with two or more compartments for holding cushioning material. In some configurations, the top side of the paddle may comprise a first compartment for holding cushioning material, a second compartment for holding cushioning material, and a third compartment for holding cushioning material. The system may also include a first piece of cushioning material, a second piece of cushioning material, and a third piece of cushioning material, the first piece of cushioning material attached to the first compartment, the second piece of cushioning material attached to the second compartment, and the third piece of cushioning material attached to the third compartment.

According to another aspect, the post of the base comprises a cylindrical post. The system may further comprise a spa cabinet support assembly having a bottom surface, the bottom surface comprising a plurality of holes to mate with the cylindrical post. In other configurations, the system may comprise a spa cabinet support assembly having a bottom surface, the bottom surface comprising a plurality of holes to mate with the lower portion of the base. For example, the lower portion of the base may be attached to the bottom surface of the spa cabinet support assembly. In some configurations, the lower portion of the base may be non-removably to the bottom surface of the spa cabinet support assembly.

According to another aspect, a structural support system for a spa my comprise: a base, the base comprising a lower portion and an upper portion; a paddle, the paddle comprising a top side and a bottom side, the top side comprising a tray and having one or more pieces of cushioning material attached thereto; wherein the bottom side of the paddle is connected to the upper portion of the base by an articulating joint.

According to another aspect, the lower portion of the base comprises a post and the upper portion of the base comprises a ball joint. In some configurations, the bottom side of the paddle comprises a socket to mate with the ball joint of the base.

According to yet another aspect, a method of supporting a spa shell is disclosed. The method may comprise: selecting at least a first structural support and a second structural support, each of the first structural and second structural support comprising: a base, the base including a post portion; a paddle, the paddle and the base connected by an articulating joint and the paddle having at least one piece of cushioning material attached to a top side thereof; placing the first structural support within two centimeters of a first low portion of the spa shell; placing the second structural support within two centimeters of a second low portion of the spa shell.

In some configurations, the first lower portion and the second lower portion comprise a concavity in the spa shell. The method may further comprise attaching the post portion to a spa cabinet support assembly. The method may further comprise selecting at least a third structural support and a fourth structural support, each of the third structural and fourth structural support comprising: a base, the base including a post portion; a paddle, the paddle and the base connected by an articulating joint and the paddle having at least one piece of cushioning material attached to a top side thereof; placing the third structural support within two centimeters of a third low portion of a spa shell; placing the fourth structural support within two centimeters of a fourth low portion of a spa shell. In some aspects, the method may comprise the step of removably and/or non-removably attaching the post portion to a spa cabinet support assembly.

BRIEF DESCRIPTION OF DRAWINGS

The following drawings illustrate what are currently considered to be specific representative configurations for carrying out the invention and are not limiting as to embodiments which may be made in accordance with the present invention. The components in the drawings are not necessarily to scale relative to each other. Like reference numerals designate corresponding parts throughout the several views.

The drawings are illustrative and not limiting of the scope of the invention which is defined by the appended claims. The various elements of the invention accomplish various aspects and objects of the invention. Not every element of the invention can be clearly displayed in a single drawing, and as such not every drawing shows each element of the invention.

DETAILED DESCRIPTION

Figure 1:
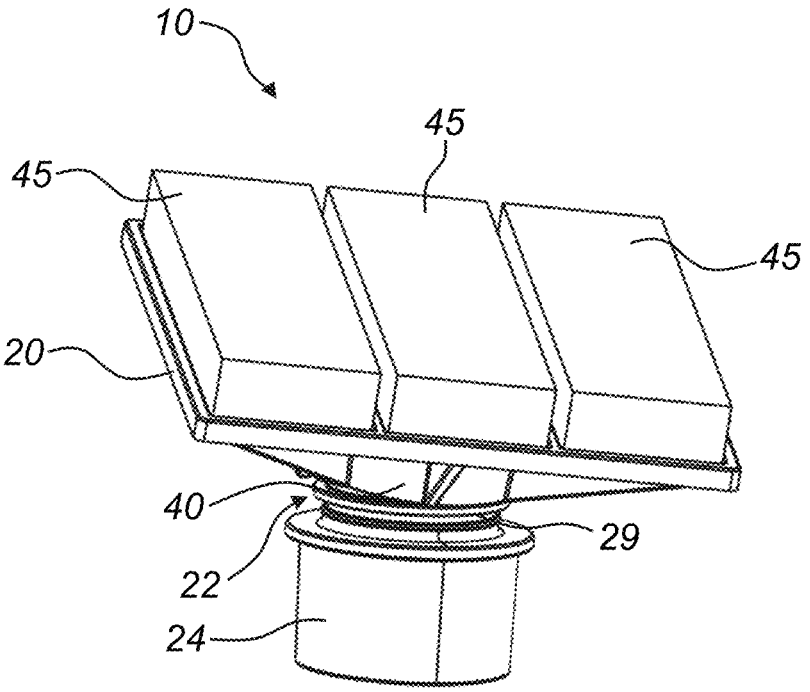
FIG. 1 shows a front perspective view of a structural paddle assembly.
Figure 2:
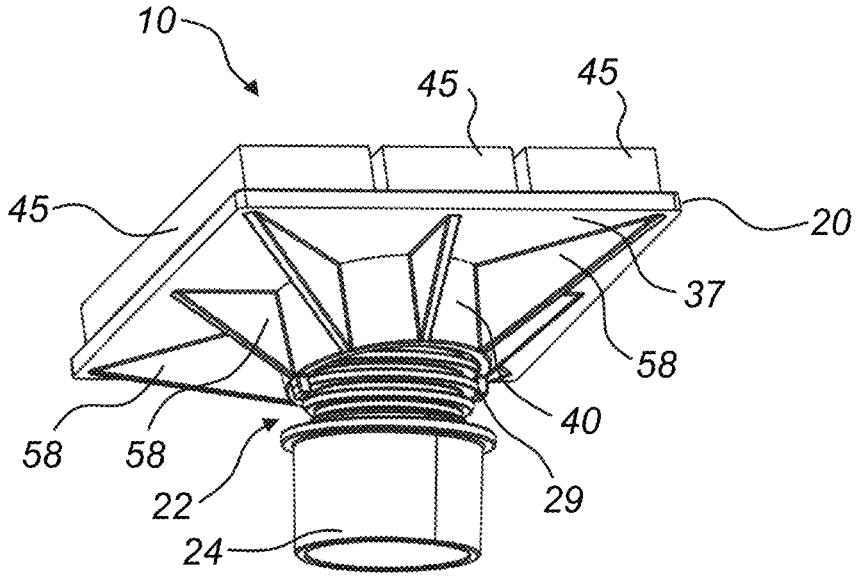
FIG. 2 shows a rear perspective view of the structural paddle assembly of FIG. 1.
Figure 3:
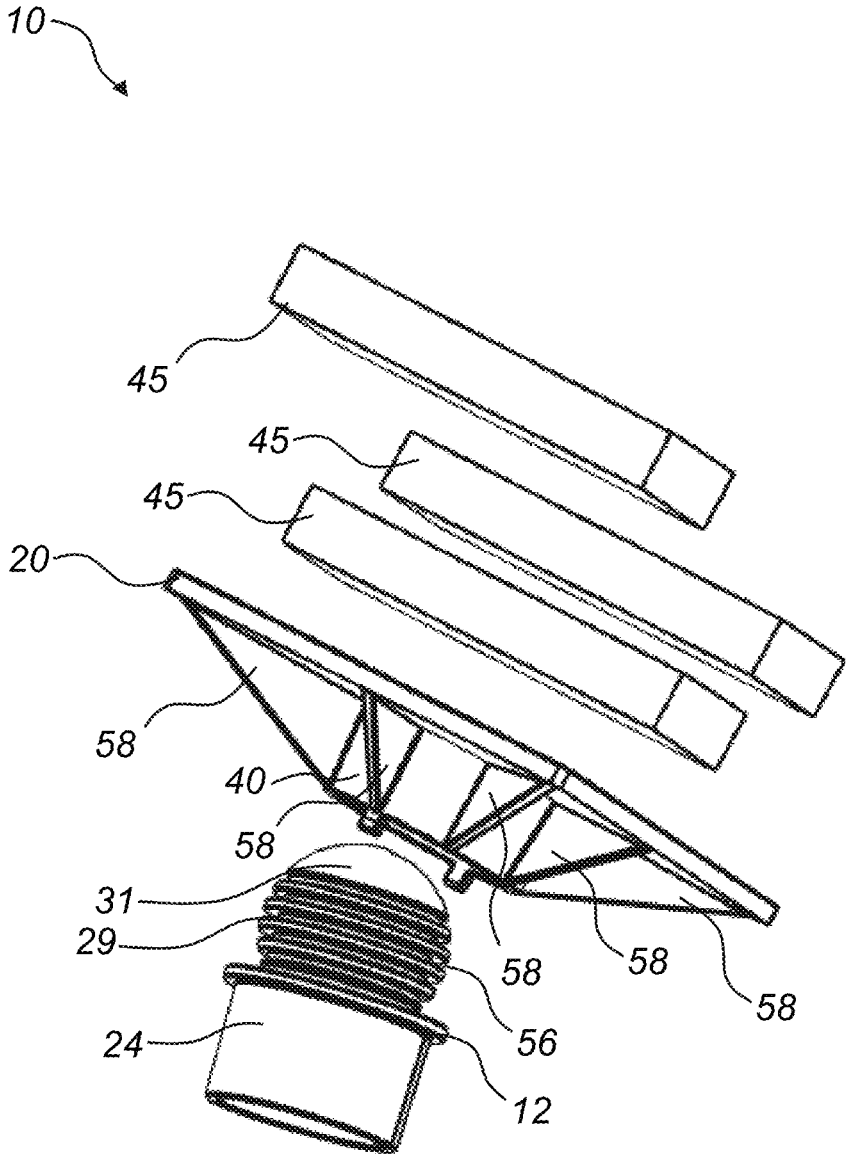
FIG. 3 shows a perspective, exploded view of the structural paddle assembly of FIG. 1.
Figure 4:
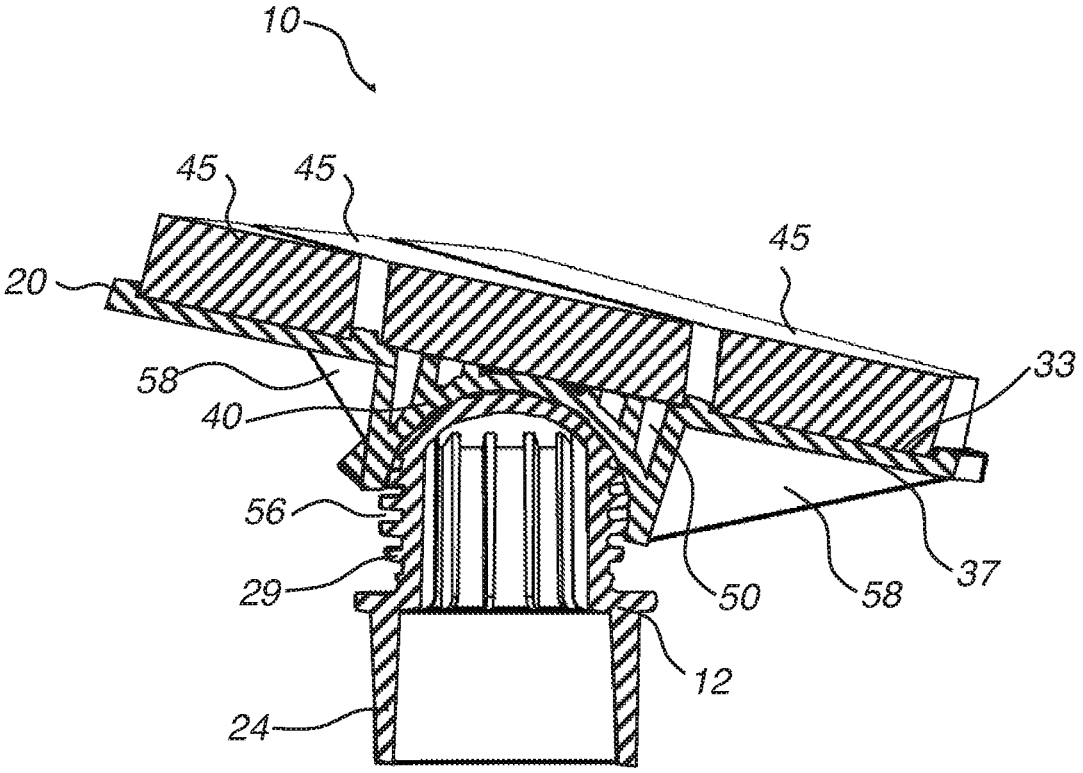
FIG. 4 shows a side, cross-sectional view of the structural paddle assembly of FIG. 1.

Hereinafter, different embodiments of the present disclosure will be described in detail with reference to the accompanying drawings. Advantages and features of the present disclosure and methods accomplishing them will become apparent from the following description of different embodiments with reference to the accompanying drawings.

It will be appreciated that various aspects discussed in one drawing may be present and/or used in conjunction with the embodiment shown in another drawing, and each element shown in multiple drawings may be discussed only once.

Reference in the specification to "one configuration" "one embodiment," "a configuration" or "an embodiment" means that a particular feature, structure, or characteristic described in connection with the configuration is included in at least one configuration, but is not a requirement that such feature, structure or characteristic be present in any particular configuration unless expressly set forth in the claims as being present. The appearances of the phrase "in one configuration" in various places may not necessarily limit the inclusion of a particular element of the invention to a single configuration, rather the element may be included in other or all configurations discussed herein.

Furthermore, the described features, structures, or characteristics of configurations of the invention may be combined in any suitable manner in one or more configurations. In the following description, numerous specific details are provided, such as examples of products or manufacturing techniques that may be used, to provide a thorough understanding of configurations of the invention. One skilled in the relevant art will recognize, however, that configurations of the invention may be practiced without one or more of the specific details, or with other methods, components, materials, and so forth. In other instances, well-known structures, materials, or operations are not shown or described in detail to avoid obscuring aspects of the invention.

It should also be noted that, as used in this specification and the appended claims, singular forms such as "a," "an," and "the" may include the plural unless the context clearly dictates otherwise. Thus, for example, reference to "a structural paddle assembly" may include one or more of such structural paddle assemblies, and reference to "the piece of cushioning material" may include reference to one or more of pieces of cushioning material.

As used herein, a plurality of items, structural elements, compositional elements, and/or materials may be presented in a common list for convenience. However, these lists should be construed as though each member of the list is individually identified as a separate and unique member.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

The present disclosure generally relates to a structural paddle assembly for supporting a spa shell. As seen in FIGS. 1-6, the structural paddle assembly 10 may generally include a base 12 and a paddle 20 connected via an articulating joint 22. The base 12 may comprise a lower portion 24 and an upper portion 29. In one configuration, the upper portion 29 comprises a ball joint 31. The lower portion 24 may be configured to mate with or otherwise attach to the bottom surface of a spa cabinet support assembly. In some configurations, the lower portion 24 may removably attached to the bottom surface of a spa cabinet support assembly. For example, the bottom surface 30 of the spa cabinet support assembly, or spa structural assembly, such as a base pan, may be provided with a plurality of holes 32 (see FIG. 7, discussed in more detail below) with which the lower portion 24 of the base 12 may mate with or otherwise fit into. In other configurations, the lower portion 24 may removably or non-removably attach to the bottom surface 30 of a spa cabinet.

The lower portion 24 may comprise a cylindrical post or post portion 26, or it may have any other suitable shape. If a cylindrical post is used, similarly shaped circles may be provided in the bottom surface 30 of the spa structural assembly to accept the cylindrical posts. It will be appreciated that other types of shapes may be used for the lower portion 24 of the structural paddle assembly, with complementary shapes within the bottom surface 30 of the spa structural assembly, and are contemplated herein. Similarly, the size of the lower portion 24 may vary in diameter and in height depending on the needs. In some configurations, the lower portion 24 may be provided in varying heights to support different portions of the spa. For example, a spa may have various concavities, or convexities, such as seats formed therein, at various heights/depths. Lower portions 24 of the structural paddle assembly may be provided in varying lengths to accommodate these varying heights/depths of the spa shell.

The upper portion 29 of the base 12 may include a joint for attachment to the paddle 20. In some configurations, a ball and socket joint may be used. Other types of articulating joints may also be used. For example, mechanical joints such as a pin joint, a screw joint, a bolted joint, a cotter joint, a knuckle joint, a turnbuckle, etc., may be used. An articulated joint may allow the paddle 20 to move relative to the base 12. For example, if weight from the spa shell presses against the paddle 20, it may be allowed to rotate and settle into a position that supports the weight. Depending on the type of joint used, the paddle 20 may rotate in a single direction or may be allowed to rotate in a plurality, or even infinite number of directions relative to the base 12.

The paddle 20 may comprise a top side 33 and a bottom side 37. The top side 33 may comprise a tray 16 (FIG. 5) which may be recessed within the paddle 20 from the top side 33 of the paddle 20. The bottom side 37 may include a joint, such as a socket 40, to mate with the base 12 as described above. The top side 33 may include one or more pieces of cushioning material 45 attached thereto. Any type of suitable cushioning material, such as foam, etc., may be used. By way of example and not of limitation, expanded polystyrene foam (EPF) may be used. Other foams such as expanded polyethylene (EPE) and ethylene-vinyl acetate (EVA) foams, or other suitable cushioning materials, etc., may also be used.

In some configurations, the top side 33 of the paddle 20 may comprise one or more separate compartments 47 or recesses, within the tray 16, for holding the cushioning material 45. For example, two compartments 47 may be provided, each of the two compartments formed from a raised ridge with an open top to receive the cushioning material 45. In other configurations, three compartments 47 (first recess 47*a*, second recess 47*b*, and third recess 47*c* in FIG. 5) may be provided, each with a piece of cushioning material 45 located therein. The compartments may each be separated or isolated from each other. For example, the compartments may comprise a compartment surrounded on five sides by the top side 44 of the paddle 20 (for example, with the top side forming the bottom side of the compartment, and four sides of the compartment formed by raised ridges around the top side). The top side may be left open for receiving a piece of cushioning material 45. Multiple pieces of cushioning material 45, each slightly spaced apart in their own compartment 47, may provide additional flexibility in the cushioning of the paddle 20 for the spa and allow for compression/expansion of the cushioning material 45. By providing multiple separated or isolated pieces of cushioning material 45, it may improve cushioning for the spa shell compared to one large single piece of cushioning material.

Figure 5:
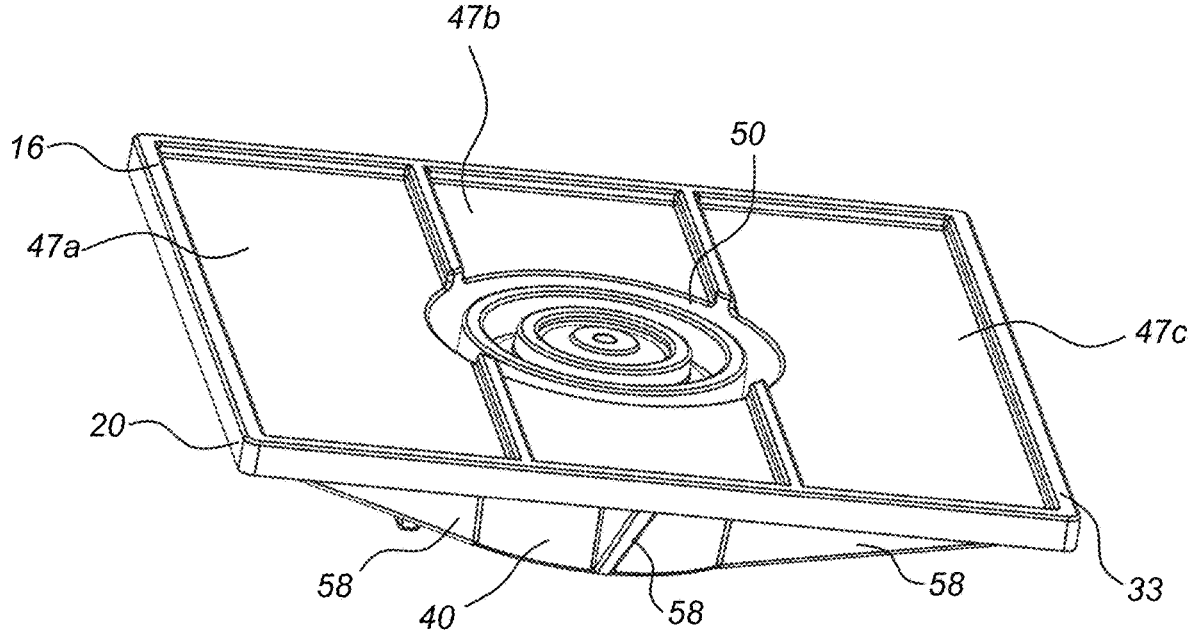
FIG. 5 shows a front, perspective view of the paddle portion of the structural paddle assembly.
Figure 6:
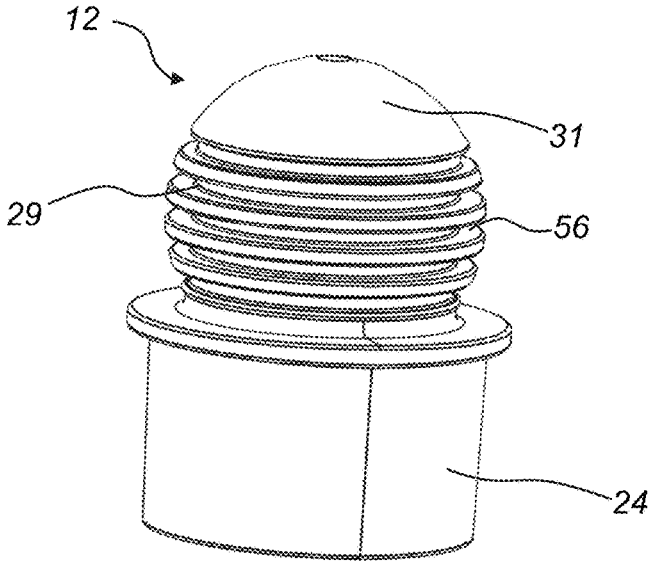
FIG. 6 shows a front, perspective view of the base portion of the structural paddle assembly.
Figure 7:
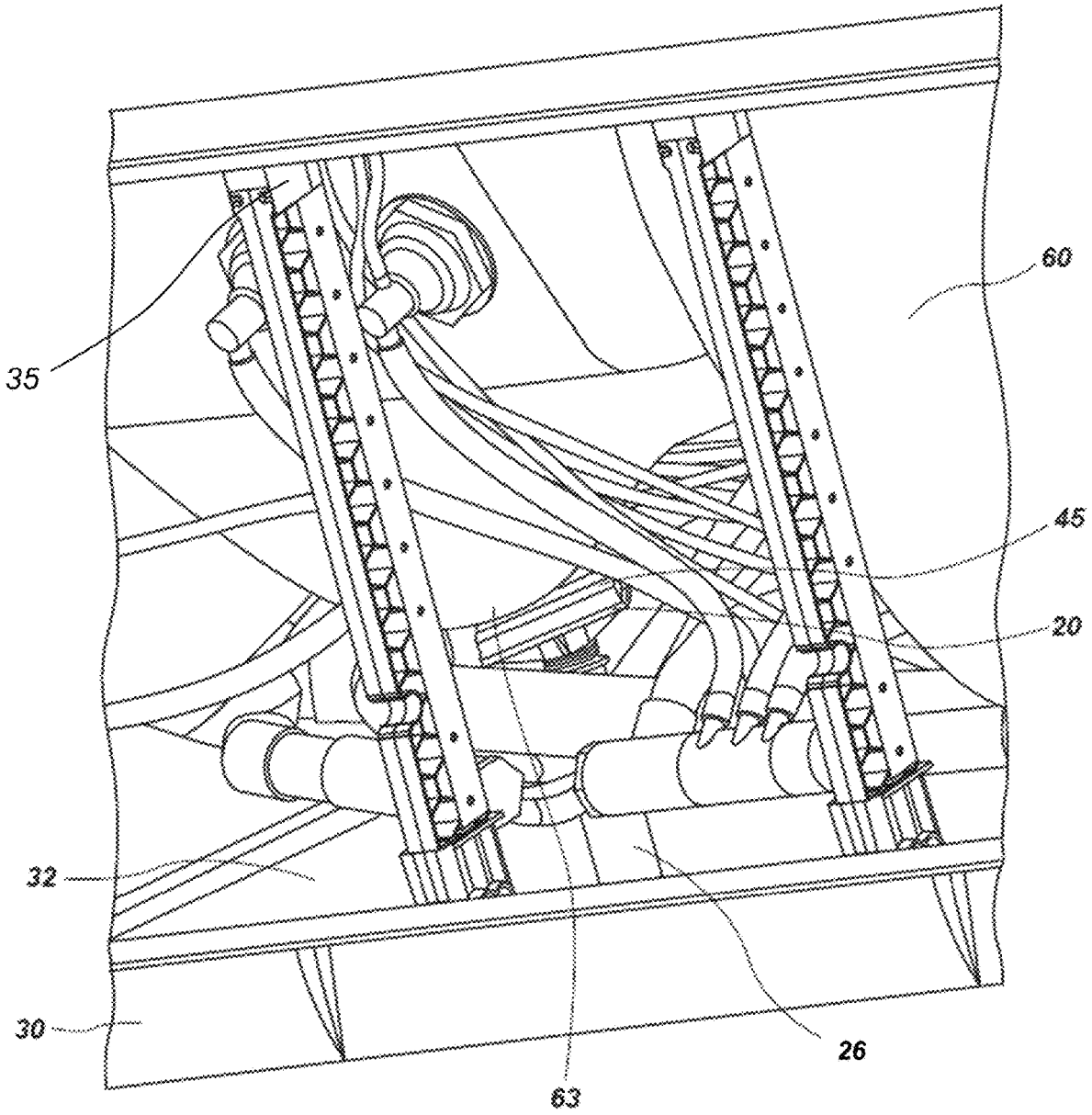
FIG. 7 shows a perspective view of a structural paddle assembly supporting a spa shell.

In some configurations, the top side 33 of the paddle 20 may also include one or more concentric circle cut-outs 50 (FIG. 5). As weight is pressed against the head of the paddle 20 and into the upper portion 29 of the base, the cut-outs may assist in keeping the cross-sectional area of the paddle 20 more constant and reduce part deformity. In other configurations, the cut-outs may be omitted. In other configurations, additional cut-outs or fewer cut-outs may be used. Similarly, the upper portion 29 of the base may include one or more grooves 56 (FIG. 6).

In some configurations, the bottom side 37 of the paddle 20 may further include one or more ribs 58 extending therefrom. The ribs 58 may provide additional structural support for the paddle 20. For example, the ribs 58 may have a thickness near the center of the paddle 20 that is approximately the same as the height of the socket 40, and the thickness of the ribs 58 may taper as the ribs extend toward the edges of the paddle 20. In this manner, the most support may be provided near the center of the paddle 20 that will hold the most weight, and the ribs may provide additional structural support for the weight-bearing center of the paddle 20 and/or distribute the weight from the center outwardly.

Figure 8:
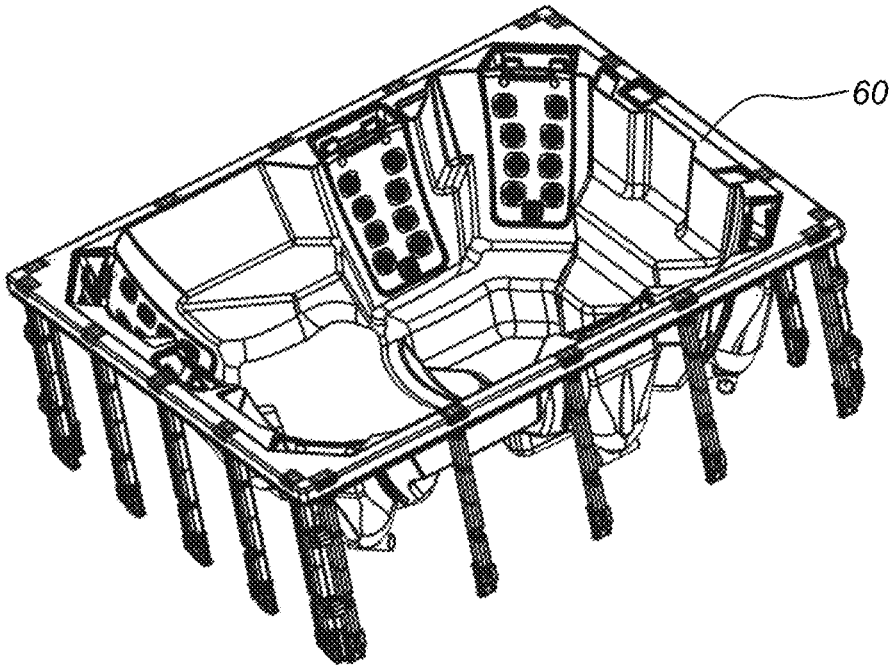
FIG. 8 shows a perspective view of a spa shell.
Figure 9:
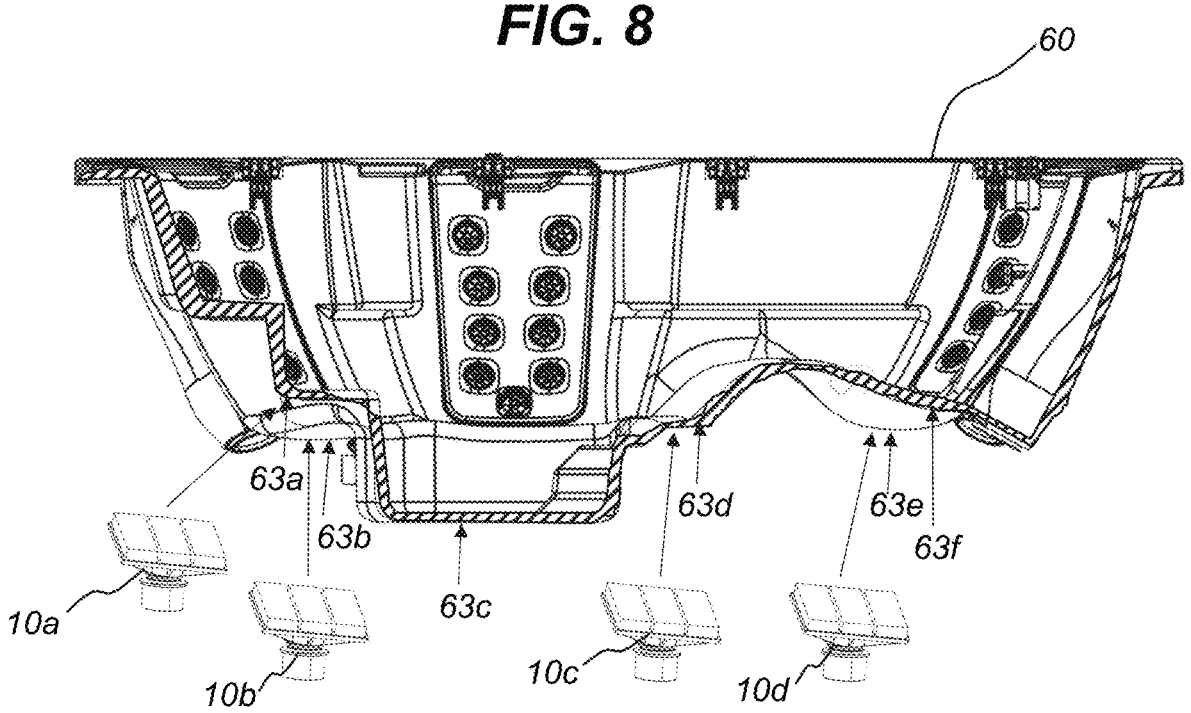
FIG. 9 shows a cross-sectional view of the spa shell of FIG. 8.

In some configurations, one or more of the structural support paddle assemblies 10 may be used to support a spa shell. For example, two, three, four, or five or more paddles assemblies may be used at varying places below the spa shell. A spa shell typically has various concavities, or convexities, formed therein, such as seats, etc. One or more structural support paddle assemblies 10 may be placed near these low portions 63 of the spa shell. FIG. 8 shows a perspective view of a spa shell 60, and FIG. 9 shows a side, cross-sectional view of the shell of the spa shell of FIG. 8, with the low portions 63 indicated, including a first low portion 63*a*, a second low portion 63*b*, a third low portion 63*c*, and a fourth low portion 63*d*. Fifth 63*e* and sixth 63*f* low portions are also indicated. A first structural paddle assembly 10*a* may be placed proximal to low portion 63*a* to support low portion 63*a*, a second structural paddle assembly 10*b* may be placed proximal to low portion 63*b* to support low portion 63*b*, a third structural paddle assembly 10*c* may be placed proximal to low portion 63*d* to support low portion 63*d*, a fourth structural paddle assembly 10*d* may be placed proximal to low portion 63*e* to support low portion 63*e*, etc. It is appreciated that various spa shells will have different numbers and positions of low portions, and any spa shell configuration is contemplated and may be supported by the paddle assembly disclosed herein. Structural support paddle assemblies may be placed in the low portions to support the spa shell. In other configurations, the structural support paddle assemblies may be placed in different positions.

A method of supporting a spa shell may include the step of selecting a first structural support paddle assembly, and placing the first structural support assembly proximal to a first low portion of a spa shell. The step may also include removably or non-removably attaching the base portion 12 of the structural support paddle assembly 10 to the spa structure's base or spa cabinet support assembly 35. In some configurations, the bottom surface 30 of the spa cabinet support assembly 35, such as a base pan, may comprise a plurality of holes 32 for the post portion 26 of the lower portion 24 of the structural support paddle assembly 10 to mate with. In other configurations, the base portion 12 of the structural support paddle assembly 10 may be otherwise removably or non-removably attached to the bottom surface 30 of the spa cabinet support assembly 35. In configurations where the lower portion 24 includes a post portion 26 of the structural support paddle 10 for fitting into voids of the spa cabinet support 35, this may allow a modular assembly for the spa structural support. For example, a standard spa cabinet with a plurality of voids in the bottom may be used to support spa shells having a plurality of different features and configurations by placing one or more structural support paddles in the appropriate locations for supporting a particular spa shell configuration. This may eliminate the need for any special support cabinet and/or custom foam.

The first structural support paddle assembly may be selected such that it has a total height (including the height of the cushioning material 45) that comes within about 0.5 centimeters to about 5 centimeters of the first low portion of the spa shell. In this manner, the spa shell may shift (for example, if placement of the structural support paddle occurs before the spa is filled with water, or due to user/water movement over time) and have space to interact with the structural support paddle. The paddle 20 may also pivot to meet the spa shell and provide support. Structural support paddles may be provided at a plurality of various heights. Alternatively, structural support paddles may be simple to adjust the height, such as by removing a portion of the post.

The method of supporting the spa shell may include the step of selecting a second structural support paddle, and placing the second structural support paddle proximal to a second low portion of a spa shell. Depending on the height/depth of the second low portion or concavity, the length of the lower portion 24 of the second structural support paddle assembly may be different than the length of the lower portion 24 of the first structural support paddle assembly. It will be appreciated that the size and shape of the spa shell may dictate how many structural support paddles assemblies may be used, and also the length of the lower portion 24 of each of the structural support paddle assemblies used. In some configurations, 1 to 10 structural support paddles may be used. More specifically, 3 to 8 structural support paddles may be used. Even more specifically, 5 to 7 structural support paddles may be used.

By supporting the spa shell with structural support paddles as described herein, a significant amount of space in the spa shell cabinet may be made available. Additionally, the support may be provided without compromising access to other portions of the spa system, such as tubing, wiring, etc. This may simplify ease in both installation and maintenance of the spa.

The various embodiments described above, including elements of the various embodiments described above, can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

Various portions and components of apparatus within the scope of the inventions, including for example, structural components, can be formed by one or more various suitable manufacturing processes known to those in the art. Similarly, various portions and components of apparatus within the scope of the inventions can be made from suitable materials known to those in the art.

The above description has set out various features, functions, methods and other aspects of the disclosure. This has been done with regard to the currently preferred embodiments thereof. Time and further development may change the manner in which the various aspects are implemented. For example, the disclosure is specifically discussed with applications to spa structure assemblies. However, the system may have other applications outside spa structure assemblies.

The scope of protection accorded the inventions as defined by the claims is not intended to be limited to the specific sizes, shapes, features or other aspects of the currently preferred embodiments shown and described. The claimed invention may be implemented or embodied in other forms while still being within the concepts shown, described and claimed herein. Also included are equivalents of the inventions which can be made without departing from the scope of concepts properly protected hereby.

We claim:

1. A structural support system for a spa, the structural support system comprising:

a base, the base comprising a lower portion and an upper portion, the lower portion comprising a post and the upper portion comprising a ball joint;

a spa cabinet support assembly having a bottom surface, the bottom surface comprising at least one void, the post of the lower portion of the base receivable in the at least one void;

a paddle, the paddle comprising a top side and a bottom side, the bottom side of the paddle comprising a socket to mate with the ball joint of the base, and the top side having one or more pieces of cushioning material attached thereto to interface with a low portion of a spa shell.

2. The structural support system for a spa of claim 1, wherein the ball joint comprises one or more grooves formed therein.

3. The structural support system for a spa of claim 1, wherein the bottom side of the paddle comprises one or more ribs attached thereto.

4. The structural support system for a spa of claim 1, wherein the top side of the paddle comprises a tray with two or more compartments for holding cushioning material, the two or more compartments comprising a first recess in the top side of the paddle and a second recess in the top side of the paddle, wherein the second recess is isolated from the first recess.

5. The structural support system for a spa of claim 4, wherein the top side of the paddle comprises a first compartment for holding cushioning material, a second compartment for holding cushioning material, and a third compartment for holding cushioning material.

6. The structural support system for a spa of claim 5, wherein the system comprises a first piece of cushioning material, a second piece of cushioning material, and a third piece of cushioning material, the first piece of cushioning material attached to the first compartment, the second piece of cushioning material attached to the second compartment, and the third piece of cushioning material attached to the third compartment.

7. The structural support system for a spa of claim 6, wherein the post of the base comprises a cylindrical post.

8. The structural support system for a spa of claim 1, wherein the top side of the paddle comprises at least one cut-out.

9. The structural support system for a spa of claim 1, further comprising a spa cabinet support assembly having a bottom surface, the bottom surface comprising a plurality of holes to mate with the lower portion of the base.

10. The structural support system for a spa of claim 1, further comprising a spa cabinet support assembly having a bottom surface, the lower portion of the base being attached to the bottom surface of the spa cabinet support assembly.

11. The structural support system for a spa of claim 1, further comprising a spa cabinet support assembly having a bottom surface, the lower portion of the base being attached non-removably to the bottom surface of the spa cabinet support assembly.

12. A structural support system for a spa, the system comprising:

a base, the base comprising a lower portion and an upper portion;

a paddle, the paddle comprising a top side and a bottom side, the top side comprising a tray and having one or more pieces of cushioning material attached thereto; and wherein the bottom side of the paddle is connected to the upper portion of the base by an articulating joint.

13. The structural support system for a spa of claim 12, wherein the lower portion of the base comprises a post and the upper portion of the base comprises a ball joint.

14. The structural support system for a spa of claim 13, wherein the bottom side of the paddle comprises a socket to mate with the ball joint of the base.

15. A method of supporting a spa shell, the method comprising:

selecting at least a first structural paddle assembly and a second structural paddle assembly, the first structural paddle assembly and the second structural paddle assembly comprising:

a base, the base including a post portion;

a paddle, the paddle and the base connected by an articulating joint and the paddle having at least one piece of cushioning material attached to a top side thereof;

placing the first structural paddle assembly within two centimeters of a first low portion of the spa shell; and placing the second structural paddle assembly within two centimeters of a second low portion of the spa shell.

16. The method of supporting a spa shell of claim 15, wherein the first low portion and the second low portion comprise a concavity in the spa shell.

17. The method of supporting a spa shell of claim 15, wherein the method further comprises attaching the post portion to a spa cabinet support assembly.

18. The method of supporting a spa shell of claim 15, wherein the method further comprises selecting at least a third structural paddle assembly and a fourth structural paddle assembly, the third structural paddle assembly and fourth structural paddle assembly comprising:

a base, the base including a post portion;

a paddle, the paddle and the base connected by an articulating joint and the paddle having at least one piece of cushioning material attached to a top side thereof;

placing the third structural paddle assembly within two centimeters of a third low portion of a spa shell; and placing the fourth structural paddle assembly within two centimeters of a fourth low portion of a spa shell.

19. The method of supporting a spa shell of claim 15, further comprising the step of removably attaching the post portion to a spa cabinet support assembly.

* * * * *